US005429027A

United States Patent [19]

Hicks

[11] Patent Number: 5,429,027

[45] Date of Patent: Jul. 4, 1995

[54] ADJUSTABLE BRIDGE HOLDER AND ELECTRIC PICKUP HOLDER FOR STRINGED INSTRUMENT

[76] Inventor: Lowell J. Hicks, Box 1030, Clarkdale, Ariz. 86324

[21] Appl. No.: 208,333

[22] Filed: Mar. 7, 1994

[51] Int. Cl.[6] ..... G10D 3/00

[52] U.S. Cl. ..... 84/291; 84/299

[58] Field of Search ..... 84/275, 291, 298, 307, 84/299

[56] References Cited

U.S. PATENT DOCUMENTS 4,385,543 5/1983 Shaw et al. ..... 84/298

5,227,571 7/1993 Cipriani ..... 84/307

*Primary Examiner*—M. L. Gellner

*Assistant Examiner*—Patrick J. Stanzione

[57] ABSTRACT

A mechanism constructed of strong and rigid material for mounting an adjustable bridge (27) and electric pickup (29) onto an acoustic upright bass instrument (A). Located at the narrow end (22) of the invention are tailgut holes (21) for securing the invention to the instrument via the tailgut used for conventional prior art tailpieces. Conveniently located in the main body ($B^1$) of the invention is a plurality of string holes (24$^h$) for locking acoustic upright bass strings (FIG. 2, (30) in their usual position in relation to the instrument. At the front upper surface of the invention is an adjustable bridge mounting surface (26) on a plane parallel to that of the fingerboard and of sufficient dimension to allow the effective placement of an adjustable bridge (27) in one of several positions relative to desired scale length of the instrument strings (FIG. 1, (30), FIG. 2, (30$^e$)). Directly in front of the bridge mounting surface and recessed on a parallel plane is an electric pickup mounting surface (28) of sufficient dimension to allow placement of an electric pickup (29) upon it. The underside of the bridge mounting surface (26) contains a cavity (40) of sufficient dimension to allow placement of electric pickup controls (FIG. 2, (41,42)). At a point where the front and tail ends of the invention meet, approximately over the sound post of the instrument (A), a support assembly ($B^2$) supports the main body ($B^1$) of the invention on the surface ($A^1$) of the instrument, seated securely by means of self seating feet (FIG. 3, (38)).

11 Claims, 2 Drawing Sheets

ADJUSTABLE BRIDGE HOLDER AND ELECTRIC PICKUP HOLDER FOR STRINGED INSTRUMENT

BACKGROUND—OF FIELD INVENTION

This invention relates to accessories to upright basses, specifically to a mechanism which mounts onto the bass instrument and holds an adjustable bridge and an electric pickup.

BACKGROUND—DESCRIPTION OF PRIOR ART

Acoustic upright basses are manufactured as orchestral instruments, historically played most often by drawing a bow across the instrument strings which are supported by a simple wooden bridge. The bridge has no means by which individual strings may be adjusted for fine tuning, or for height above the fingerboard.

With a recent popularity of playing the upright bass in the pizzicato style, it has become desirable to adjust the instrument strings to be closer to the fingerboard than they are in a conventional bow playing position. The desired adjustment is accomplished by a trial and error process of removing the strings, cutting or filing material from the bridge at point where a string crosses, replacing the strings to check adjustment, and repeating the process until a satisfactory adjustment is achieved. This process of removing material from the bridge is for practical purposes not reversible, and therefore must be accomplished through several incremental and tedious stages.

Also gaining in popularity is the trend to amplify the sound of the bass by installing an electric contact microphone. Presently, the microphone is affixed to the bridge or the body of the bass by means of an adhesive or a clip. This type of microphone tends to create unwanted noise in the amplified signal.

Also gaining in popularity is a trend for electric bass guitar players to switch to playing the acoustic upright bass. Because the electric bass guitar has a shorter scale than that of the acoustic upright bass, the transition from playing the electric bass guitar to playing the acoustic upright bass requires a difficult adjustment in fingering technique. Because of this, many competent electric bass guitar players have quickly abandoned the challenge of learning to play the acoustic upright bass. In my search of prior art in classes 84/298, 84/299, 84/302, 84/455, and 84/458 I found no single invention which addresses each of the problems I have just discussed.

Therefore, acoustic upright basses heretofore known suffer from a number of disadvantages:

(a) They are not fine-tunable at the bridge with regard to one string's relation to the next string at the same position on the fingerboard.

(b) They do not have a means for simply and quickly adjusting and re-adjusting the height of individual strings in relation to the fingerboard.

(c) They do not allow the convenient repositioning of the bridge in order to shorten the scale length to that of an electric bass guitar so that the instrument may be made quickly accessible to the technique of an electric bass guitar player.

(d) They do not have means for mounting one of a number of high quality electric bass guitar style pickups.

OBJECTS AND ADVANTAGES

Accordingly, several objects and advantages of my invention are:

(a) To provide a single, easily installable mechanism on which may be mounted one of a number of brands and styles of adjustable bridge that allows the fine tuning of individual strings as they relate to each other at a given common position on the fingerboard;

(b) To provide a single, easily installed mechanism on which may be mounted one of a number of brands of adjustable bridge that allows the simple and quick adjustment of the height of individual strings in relation to the fingerboard;

(c) To provide a single, easily installed mechanism on which may be mounted one of a number of brands and styles of adjustable bridge in a number of different positions so that the scale length of the bass strings may be conveniently altered to suit the playing technique of the user;

(d) To provide a single, easily installed mechanism on which may be mounted one of a number of brands and styles of electric bass guitar pickup.

A further object and advantage of the invention is that it allows the option of replacing acoustic upright bass strings with one of a number of brands and types of electric bass guitar strings on an acoustic upright bass when the invention is utilized to create a scale length similar to that of an electric bass guitar.

DRAWING FIGURES

In the drawings, closely related figures have the same number but different alphabetic suffixes.

Reference Letters and Numerals in Drawings

| | | | |
|---|---|---|---|
| A | upright acoustic bass | $A^1$ | surface of upright acoustic bass |
| B | adjustable bridge holder and pickup holder | $B^1$ | main body of invention |
| $B^2$ | support assembly | 21 | tailgut holes |
| 22 | narrow end of invention | 23 | point at approximate half length of invention |
| 24 | string slots | 25 | approximate thickening point in invention |
| 26 | bridge mounting surface | 27 | adjustable bridge |
| 28 | electric pickup mounting surface | 29 | electric pickup |
| 30 | acoustic upright bass strings | $30^c$ | electric bass guitar strings |
| 31 | conventional prior art acoustic upright bass bridge | 32 | conventional prior art tailpiece |
| 33 | support assembly main body | 34 | threaded vertical adjusment rods |
| 35 | threaded nuts | 36 | washers |
| 37 | holes | 38 | balls |
| $38^b$ | flattened area | 39 | sockets |
| 40 | cavity | 41 | signal connecting means |
| $41^a$ | hole for signal connecting means | 42 | means for controlling |

-continued

| Reference Letters and Numerals in Drawings | | | |
|---|---|---|---|
| $42^{a,b}$ | mounting hole for means for controlling signal | X | signal angle |

DESCRIPTION—FIGS. 1 to 4

Figure 1:
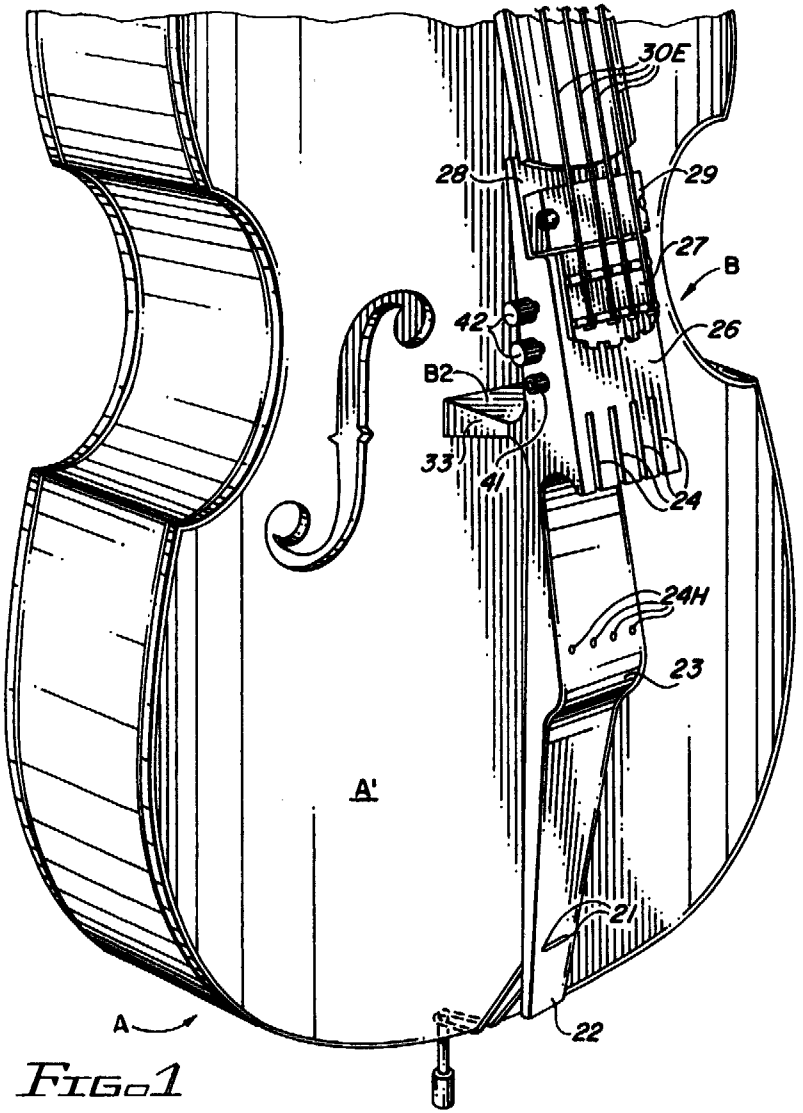
FIG. 1 shows a portion of an acoustic upright bass with invention attached, having an adjustable bridge, electric pickup, and electric bass guitar strings mounted in operating position.

Referring to FIG. 1, a portion of an acoustic upright bass instrument A is disclosed which has attached thereto a preferred embodiment of an adjustable bridge holder and electric pickup holder B made in accordance with this invention, and having an adjustable bridge 27 and a pickup 29 in operating position and utilizing electric bass guitar strings $30^e$.

Figure 2:
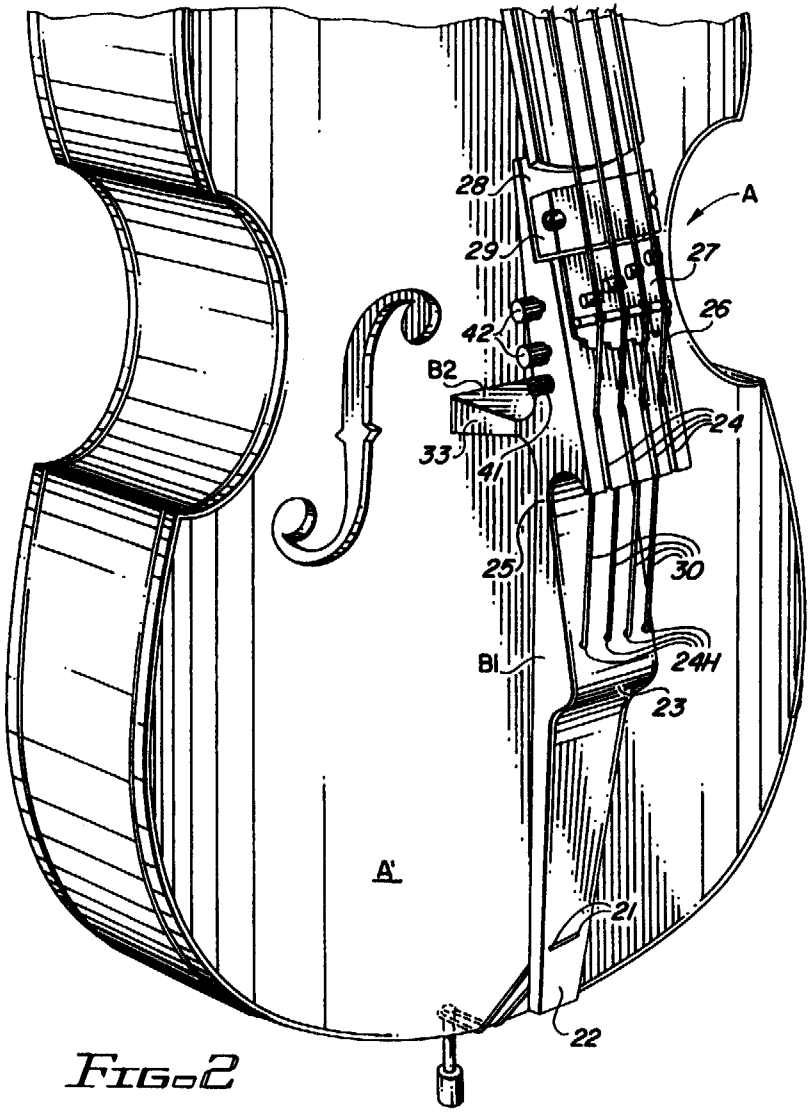
FIG. 2 shows a portion of an acoustic upright bass with invention attached, having an adjustable bridge, electric pickup, and acoustic upright bass strings mounted in operating position.
Figure 3:
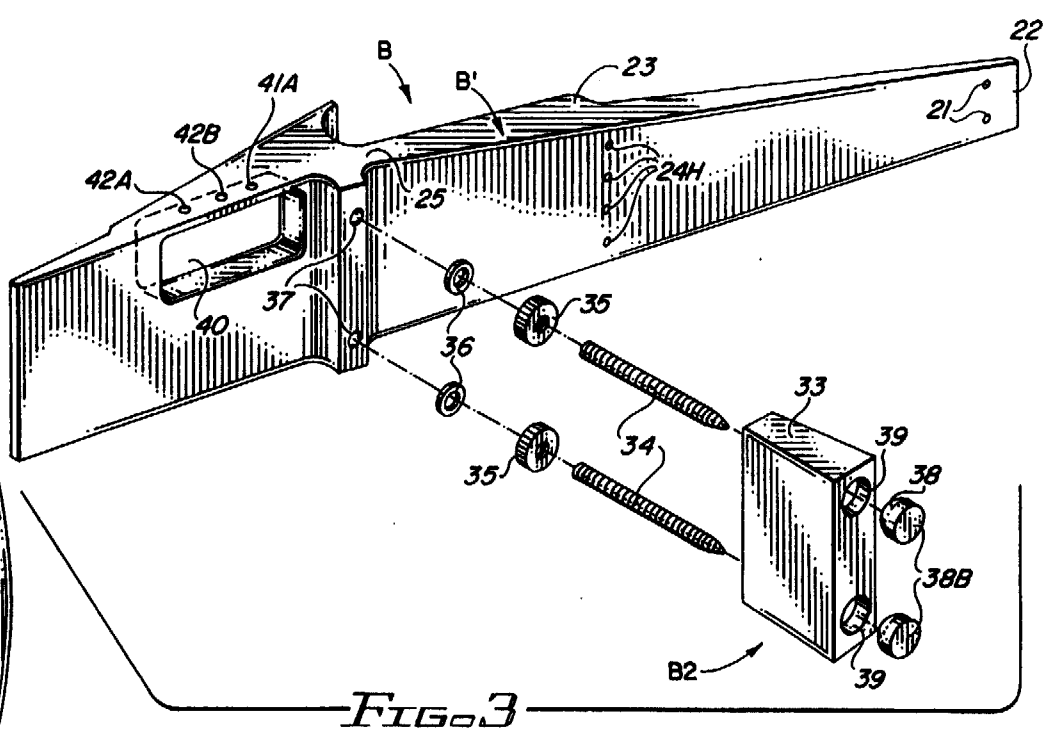
FIG. 3 shows an exploded view of the invention's underside, including the support assembly with self-seating feet.

The adjustable bridge holder and electric pickup holder B, as seen in FIGS. 1, 2, and 3, may be advantageously formed of a strong and rigid material such as plastic, hardwood, aluminum, carbon fiber or the like.

Figure 4:
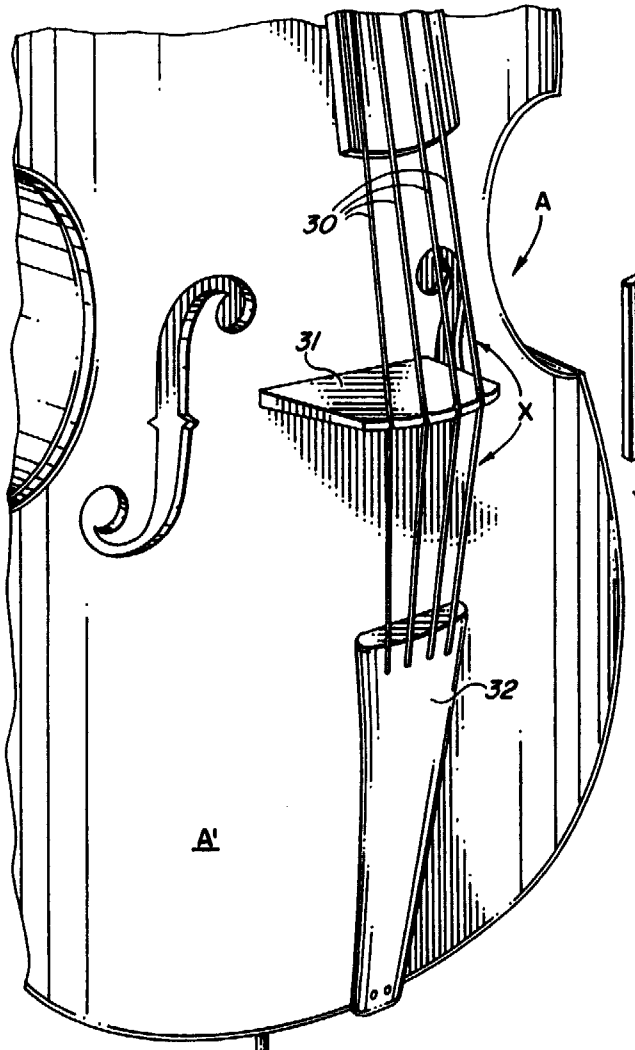
FIG. 4 (PRIOR ART)
FIG. 4 shows a portion of an acoustic upright bass with conventional prior art bridge and tailpiece and acoustic upright bass strings attached.

Best seen in FIG. 2, a narrow end 22 of the invention B is of sufficient dimension to allow convenient placement of tailgut holes 21 which are drilled through the invention at points comparable to the location of the tailgut holes in a conventional prior art tailpiece 32 (FIG. 4).

Referring again to FIG. 2, we start at narrow end 22 where the invention begins a constant gradual increase in thickness and width until at a point 23 approximately half way along the total length of the invention the thickness and width have each about doubled, thereby adding sufficient mass to advantageously accommodate installation holes $24^h$ for full length acoustic upright bass strings 30. From point 23 the invention continues a constant increase in width while beginning a constant decrease in thickness until reaching a point 25 having the approximate thickness of starting point 22. The shape of the invention at point 25 exhibits an abrupt thickening in mass and then resumes a constant and more radical decrease in thickness while maintaining a constant width throughout the length of an adjustable bridge mounting surface 26. At the front of the bridge mounting surface 26 the surface drops about two centimeters and continues decreasing thickness at the same constant on a parallel plane, still maintaining the constant width throughout the length of the pickup mounting surface 28.

The adjustable pickup mounting surface 26 has at its rear a plurality of string slots 24 cut and spaced to sufficient dimension to allow the convenient installation of full length instrument strings 30 through the slots and into holes $24^h$ as shown in FIG. 2.

The parallel planes of surface 26 and surface 28 are parallel to the longitudinal axis of the instrument fingerboard and form an angle with the longitudinal axis of the invention's main body $B^1$ as defined between narrow end 22 and point 25. This angular orientation approximates the angle X formed when the instrument's strings 30 cross a conventional prior art acoustic upright bass bridge 31 and attach to a conventional prior art tailpiece 32 as shown in FIG. 4.

FIG. 2 shows that approximately on a vertical line and below point 25 the main body $B^1$ of the invention has attached to it a support assembly $B^2$.

Referring to FIG. 3 we see the support assembly $B^2$ comprising a main body 33, threaded vertical adjusting rods 34, threaded nuts 35, washers 36, and self seating feet 37. The support assembly $B^2$ is of sufficient width to allow stable support of the main body $B^1$ of the invention and is of sufficient height to allow vertical adjustment of the invention's main body so that convenient proximity of the adjustable bridge 27 to the instrument surface $A^1$ and electric pickup 29 to the instrument strings 30 is achieved, as shown in FIGS. 1 and 2. The vertical adjusting rods 34, threaded nuts 35, and washers 36 may be made from a strong and rigid material such as plastic, metal, or the like.

The vertical adjusting rods 34 are screwed securely into the top of the support assembly main body 33 and protrude vertically, fitting loosely into holes 37 in the underside of the invention's main body $B^1$ which rests upon washers 36 installed over the threaded vertical adjusting rods 34 and against the threaded nuts 35.

In FIG. 3 it can be seen that in the base of the support assembly main body 33 is a plurality of self seating feet 37. In the preferred embodiment of the invention disclosed in FIGS. 1, 2, and 3, the self seating feet are of a ball 38 and socket 39 system, each ball having a uniform flattened area $38^b$ at its bottom, where the ball meets the instrument surface $A^1$. A remaining rounded portion of-the ball fits into a hemispheric socket 39 in the base of the support assembly main body 33. The self seating feet are spaced apart advantageously to provide stable support of the invention upon the instrument surface $A^1$.

Looking again to FIG. 3, it can be seen that cut into the underside of the invention's main body $B^1$ beneath the surface 26 (FIG. 2) and just foreward of the area where the support assembly $B^2$ is attached to the invention's main body is a cavity 40 of sufficient dimension to contain a means 41,42 (FIGS. 1,2) for sending and controlling a signal from the electric pickup 29. A plurality of holes $41^a$, $42^{a,b}$ for mounting the means for sending and controlling the signal is located through the side of the main body $B^1$ and into the cavity 40.

OPERATION—FIGS. 1, 2, and 3

The manner of installing the adjustable bridge holder and electric pickup holder is quite similar to installing a conventional prior art wooden bridge 31 (FIG. 4) and tailpiece 32 (FIG. 4), as anyone skilled in the art will find. The narrow end 22 of the invention has holes 21 for threading tailgut and securing it to the instrument A with the same technique as is used for a conventional prior art tailpiece.

After securing the narrow end 22 to the instrument A the support assembly $B^2$ is placed in position by inserting the threaded adjustment rods 34, with nuts 35 and washers 36 threaded to about mid-length, into the holes 37 in the underside of the invention's main body $B^2$.

Next, with the invention loosely in place, the process of installing an adjustable bridge is accomplished in two simple steps: The desired scale length is measured from the top extremity of the fingerboard to a point on the adjustable bridge mounting surface 26 and marked for reference. One of a number of brands and styles of adjustable bridge may then be centered on the mounting surface in a position so that the saddles of the bridge may when adjusted travel longitudinally forward and rearward across the marked reference point. When a satisfactory average scale length is achieved, the bridge 27 may be secured to the surface 26, using screws supplied by the bridge manufacturer.

Next, one of a number of brands and styles of electric pickup 29 is installed on the electric pickup mounting surface 28 in the same manner as is used to install a pickup on an electric bass guitar. Anyone skilled in the art will find the electric pickup installation process a simple one, and may have a variety of techniques suited to his or her own requirements.

The strings may now be installed. If a shorter scale has been chosen to accommodate electric bass guitar strings 30$^e$, those strings may be installed exactly as they would onto an electric bass guitar, a process known well to anyone skilled in the art.

Acoustic upright bass strings 30 may be used with any scale length on the instrument, and are installed in the same manner as is used to attach them to a conventional prior art tailpiece:

The strings are threaded through the string holes 24$^h$, travelling from the underside of the invention's main body $B^1$ in a direction generally up and forward. The strings are pulled through the holes until the locking ball end of the string stops at the point of contact with the invention, just as in a conventional prior art tailpiece. The strings then pass through their respective string slots 24 and across their respective saddles on the adjustable bridge 27, as shown in FIG. 2. The strings are then attached to the tuning machines of the instrument in the usual manner. The instrument may now be tuned for approximate pitch, and the desired string height may be approximately set. The tension created when the strings are tuned will cause a downward force upon the invention and support assembly, securing the invention to the instrument surface $A^1$ in the same manner as is seen in prior art bridge installation. To set string height, the user simply turns the threaded adjustment nuts 35 (FIG. 3) to increase or decrease the distance between the strings and fingerboard. Once a satisfactory average distance is achieved, fine adjustment for height and fine tuning of the strings may be achieved by making the appropriate adjustments to the adjustable bridge, a process well known to anyone skilled in the art. Having completed this fine adjustment, the user has now completed the installation of the invention onto the instrument .

SUMMARY, RAMIFICATIONS AND SCOPE

Accordingly, the reader will see that the adjustable bridge holder and electric pickup holder of this invention can be used to make the acoustic upright bass accessible to a person who has played only electric bass guitars previously, can be used to facilitate the use of high quality electric bass guitar style pickups on an acoustic upright bass, and can be used to facilitate the tuning of the instrument's strings in a way more perfect than was previously possible on conventional prior art acoustic upright bass bridges. In addition, when an adjustable bridge holder and electric pickup holder has been installed to create a shorter scale such as that of an electric bass guitar, the user has an option of using electric bass guitar strings or using acoustic upright bass strings on the instrument.

Although the description above contains many specificities, these should not be construed as limiting the scope of the invention, but as merely providing illustrations of a preferred embodiment of this invention. For example, the invention may be altered in appearance by omitting non-essential material from its mass, or by fabricating the essential structural shape from tubular components and plates, etc..

Thus the scope of this invention should be determined by the appended claims and their legal equivalents, rather than by the examples given.

I claim:

1. A mechanism for mounting an adjustable bridge and electric pickup onto an acoustic stringed instrument having a bridge region, including in combination:

an elongated main body of strong, rigid material having an upper surface and an underside, and which includes a tail end, a mid section, and a front end;

said tail end of said main body constructed for tail gut attachment to said instrument;

said mid section of said main body having anchoring means for fixing the ends of strings of an acoustic stringed instrument in proper playing position;

said upper surface of said front end of said main body including an area for mounting an adjustable bridge and an electric pickup; and a vertically adjustable support assembly for effecting vertical adjustment of said main body relative to said stringed instrument while supporting said main body on a surface of said stringed instrument.

2. The combination according to claim 1 wherein said elongated main body extends from the tail end thereof beyond the bridge region of said stringed instrument.

3. The combination according to claim 1 wherein said tail end, said mid section, and said front end of said main body are made of a single unitary piece of rigid material.

4. The combination according to claim 1 wherein the thickness of said front end of said main body is greater than the thickness of said tail end of said main body in said area for mounting said adjustable bridge.

5. The combination according to claim 4 wherein said mid section of said main body has parallel spaced string slots therein between said area for mounting said adjustable bridge and said tail end thereof, and wherein said anchoring means for fixing the ends of strings of said stringed instrument comprises spaced installation holes aligned with and corresponding to each of said string slots.

6. The combination according to claim 5 wherein said vertically adjustable support assembly includes adjusting rods and self-seating feet for moving the underside of said main body toward and away from said surface of said stringed instrument.

7. The combination according to claim 6 wherein said support assembly is located under said main body between said front end and said mid section thereof.

8. The combination according to claim 1 wherein said adjustable bridge includes apparatus for fixing the ends of strings for a short scale.

9. The combination according to claim 1 wherein said mid section of said main body has parallel spaced string slots therein between said area for mounting said adjustable bridge and said tail end thereof, and wherein said anchoring means for fixing the ends of strings of said stringed instrument comprises spaced installation holes aligned with and corresponding to each of said string slots.

10. The combination according to claim 9 wherein said vertically adjustable support assembly includes adjusting rods and self-seating feet for moving the underside of said main body toward and away from said surface of said stringed instrument.

11. The combination according to claim 10 wherein said support assembly is located under said main body between said front end and said mid section thereof.

* * * * *